United States Patent [19]

Enberg

[11] Patent Number: 4,637,302

[45] Date of Patent: Jan. 20, 1987

[54] AIR SUPPLY DEVICE

[75] Inventor: Helge Enberg, Enköping, Sweden

[73] Assignee: AB Bahco Ventilation, Sweden

[21] Appl. No.: 766,145

[22] Filed: Aug. 16, 1985

[30] Foreign Application Priority Data

Aug. 20, 1984 [SE] Sweden ..... 8404153

[51] Int. Cl.[4] ..... F25B 1/00

[52] U.S. Cl. ..... 98/115.3; 98/36; 98/40.18

[58] Field of Search ..... 98/36, 40.18, 115.1, 98/115.3; 126/299 D

[56] References Cited

U.S. PATENT DOCUMENTS

| | | | |
|---|---|---|---|
| 3,400,649 | 9/1968 | Jensen | 126/299 D |
| 4,043,319 | 8/1977 | Jensen | 126/299 D |
| 4,211,154 | 7/1980 | Eakes | 98/115.3 |
| 4,397,226 | 8/1983 | Lind | 98/115.1 |

*Primary Examiner*—Ronald C. Capossela

[57] ABSTRACT

An air supply device (17,18) including an elongated blow opening (23) for blowing ejector air (P1,P3) directed towards an exhaust device for entraining polluted air or other gases which are to be exhausted. A casing (17,18) is provided with a shield wall (19,20) adjacent to one side of the blow opening (23), so that the polluted air or other gases are caused to flow (P2) around the casing and to be entrained (P1) adjacent to the other side of the blow opening.

9 Claims, 3 Drawing Figures

AIR SUPPLY DEVICE

The present invention relates to an air supply device including an enlongated blow opening for blowing ejector air directed towards an exhaust device for entraining polluted air which is to be exhausted.

Exhaust devices of such a kind are known from SE-B-No. 7904443-4 and SE-No. 8305034-4, these devices comprising an elongated exhaust hood having a rear hood wall and adjoining side walls, the air supply device being formed as a box-like casing arranged at the lower edge of the rear hood wall and having at the top thereof an elongated blow opening in the form of a row of small holes. If such an exhaust hood is arranged on a work bench, e.g. in a laboratory, the row of holes will be located somewhat above the bench surface corresponding to the height of the casing, and therefore the ejector air will be effective only above this level and, thus, cannot entrain heavy gases and air-borne impurity particles gathered closely above the bench surface.

A method to entrain such heavy gases and impurity particles is of course to lower the air supply casing into the work bench itself or the like, so that the blow openings will be located in the plane of the bench surface. Such an arrangement, however, involves a non-desired modification of the work bench which might be complicated, expensive and difficult to alter.

The main object of the present invention is therefore to achieve an air supply device of the kind referred to above, which can be mounted freely relative to the underlying or surrounding surfaces and, in spite thereof, will secure an effective entrainment of air around the entire casing. As stated in claim 1, this object is achieved in that the air supply device comprises a casing provided with a shield wall adjacent to one side of the blow opening, so that polluted air or other gases, which are to be exhausted, are caused to flow around the casing and to be entrained adjacent to the other side of the blow opening. Thus, a suction effect will appear at the side of the casing opposite to the shield wall, e.g., at the underside and polluted air and other gases will be caused to flow towards the casing, around the same on both sides (e.g. at the top and at the bottom), and thereafter be united into a common stream being influenced by the ejector air and possible guiding surfaces (e.g. a rear hood wall).

The casing may advantegeously be located at some distance from a hood wall adjoining said exhaust device, so that the hood wall forms a guiding surface being either planar or curved for a desired deflection of the stream. The shield wall of the casing may be inclined towards the hood wall, so that the ejector air flows obliquely towards the hood wall and effectively conveys polluted air and other gases, which have entered into the space between the casing and the hood wall.

Furthermore, the casing may be disposed at some distance above a table or bench surface or the like, i.e. in case the exhaust device is intended to be placed on a table or a bench. Then, a gap is formed between the casing and the bench surface, through which polluted air and other gases, in particular heavy gases, enters by suction. It is also conceivable to let the bench surface continuously adjoin a rear hood wall, possibly by way of special deflecting plates being connected to the respective surfaces, e.g. with a rounded profile.

Preferably, the casing also has a rounded profile, in particular at the side opposite to the shield wall, e.g. the underside, in order to enhance a low-turbulent flow of polluted air and other gases around the circumferential surface of the casing.

In practice, it is advantageous to manufacture the casing and the shield wall in one piece, e.g. of galvnized plate, acid-proof plate, or of rigid thermoplastic material, e.g. olefine plastic, such as polyethylene or polypropylene, or vinlychloride plastic, such as polyvinylchloride, or a fibre-reinforced thermosetting plastic material, e.g. glass-fibre-reinforced polyester.

If a plate is used, it can easily be bent in such a way that an edge portion forms an essentially plan shield wall, a mid-portion forms the casing itself with a rounded profile and the opposite edge portion forms a short wall portion extending essentially in parallel to the shield wall and forming a slot constituting the blow opening of the casing.

Other features and advantages of the invention will appear from the following description of a preferred embodiment with reference to the appended drawing.

Figure 1:
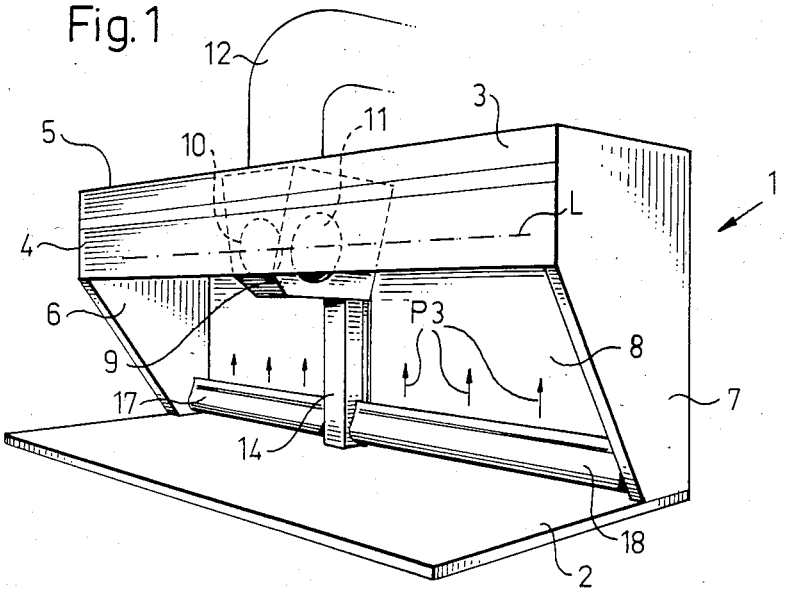
FIG. 1 shows in a perspective view an exhaust hood provided with an air supply device according to the invention.

The exhaust hood 1 in FIG. 1 is placed onto a table 2 and comprises, as known per se, an upper hood portion 3, consisting of a vertical front hood wall 4, an upper horizontal hood wall 5, side walls 6 and 7 and a rear hood wall 8, the side walls 6,7 and the rear hood wall 8 being extended downwardly all the way down to the table 2. Centrally, in the upper hood portion 3, there is a deflection housing 9 which is provided with two exhaust openings 10, 11 (only the opening 11 is visible in FIG. 1) facing each side wall 6 and 7, respectively, and connected via an exhaust channel 12 (FIG. 1) to a non-shown exhaust air fan. The deflection housing 9 comprises deflection and shield plates (here not shown) such as those described in detail in the above-mentioned SE-8305034-4. By this arrangement, two co-axial rotational flow patterns are devloped in the hood between each side wall 6 and 7, respectively, and the respective exhaust opening 10,11 around the dash-dotted axis L in FIG. 1. These rotational flows absorb polluted air and other gases, which are thus exhausted via the deflection housing 9 and the exhaust channel 12.

Figure 2:
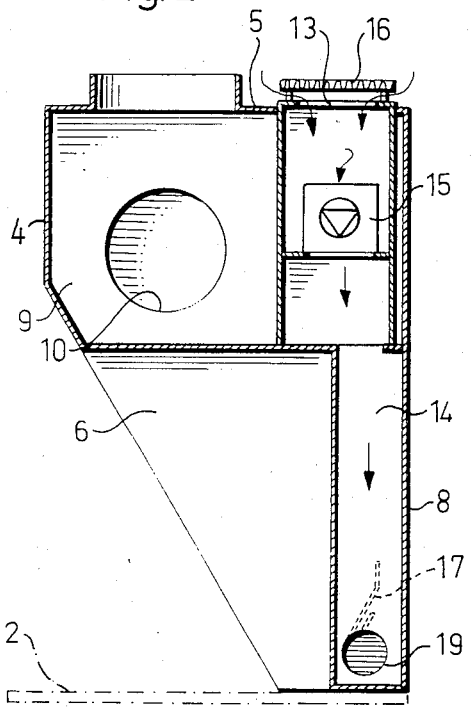
FIG. 2 shows a central cross-section through the device in FIG. 1.

According to the present invention, an especially designed air supply device is adapted to blow ejector air upwardly from the lower part of the rear hood wall 8, This air supply device comprises an inlet opening 13 (FIG. 2) located at the top of the upper hood wall 5 behind the deflection housing 9 and connected to a vertical feed channel 14, which contains an air supply fan 15 and extends centrally adjacent to the rear hood wall 8, as appears from FIGS. 1 and 2. Above the inlet opening 13, a sound-absorbing plate 16 is disposed in order to reduce the noise generated by the fan.

The feed channel 14 is connected at the lower end to two air supply casing portions 17,18 extending in parallel to the rear hood wall 8 at some distance from the lower edge portion thereof and, thus, also in parallel to the axis L, around which the two rotational flows are generated in the upper portion of the hood 1. Each air supply casing 17,18 is fastened at its ends, in a manner not shown, to the side walls 6 and 7, respectively (so that the outer end is closed) as well as to the lower end portion of the feed channel 14 by way of corresponding side openings 19 (one is visible in FIG. 2).

Figure 3:
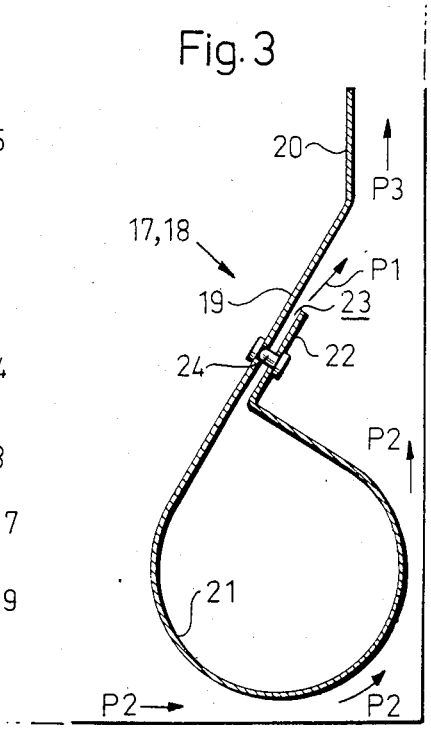
FIG. 3 shows in a larger scale a cross-section through the air supply casing itself.

As appears best from FIG. 3, each air supply casing 17,18 consists of a bent plate having upper front portions 19,20, a substantially tubular, rounded portion 21 adjoining thereto, and a relatively short, rear portion 22, which extends in parallel to the portion 19. Between the portions 19 and 22, an elongate blow opening 23 is formed, through which inlet air is blown as ejector air adjacent to the rear hood wall 8. The upper, front portions 19,20 serve as a shield wall against polluted air and other gases flowing from the area above the table 2 in the direction towards the rear hood wall 8. By this arrangement, the main entrainment is effected in the region behind the shield wall portions 19,20, namely between these portions and the rear hood wall 8, mainly in the region indicated be the arrow P1 in FIG. 3. This results in a suction effect below and behind the casing 17,18, so that polluted air and other, in particular heavy gases flow along the bottom and rear circumferential surface of the casing (arrows P2 in FIG. 3). The ejector air and the entrained air as well as other gases thereafter flow upwardly, while being shielded behind the wall portion 20, in a common stream P3, which in the region above the upper edge of the air supply casing continues upwardly along the hood wall 8 for entraining air at a higher level and other, lighter gases to be exhausted. Thus, a stream directed towards the rear hood wall 8 will be generated, below as well as above the air supply casing portions 17,18.

In the shown example, the shield wall portion 19 is inclined at about 30° relative to the vertical, rear hood wall 8 and merges with an end portion 20 extending vertically and thus in parallel to said hood wall 8, resulting in a good guiding of the upwardly flowing air therebetween. The width of the blow opening 23 is kept at a desired value in that the plate, upon being bent, is slightly prestressed in a widening direction, and are simple rivet or screw fasteners 24 being distributed along the longitudinal direction of the casing portions so as to keep the plate in its shown position with a well-defined blow opening 23.

The air supply casing portions 17,18 may of course be replaced by only one elongated casing being fed from one end thereof adjacent to the corresponding side wall. Furthermore, the detailed design of the air supply casing may be modified at wish within the scope of the claims. In principal, a circular-cylindrical tube provided with obliquely upwardly facing hole openings at its rear side may possibly be used, wherein the upper portion of such a tube forms a shield, though with reduced shielding effect as compared to the shown example. The shield wall is not necessarily inclided, and the casing profile may also be modified at wish. The air supply casing may alternatively be suspended in brackets extending from the rear hood wall or may rest on supports directly on the table surface, possibly as a loose unit with hose connections to a supply air fan. It is also possible to suspend the air supply casing entirely freely at a desired distance below an exhaust hood, the design of which is not either directly related to the inventive concept. The essential feature is that a shield wall is disposed at one side of the blow opening, so that entrainment will occur adjacent to the other side of the blow opening, thereby resulting in a certain suction effect causing the polluted air or other gases to flow around the casing. Of course, the air supply opening may consist of a simple slot, a row of holes or a set of nozzles. The air supply opening should be elongated but not necessarily rectilinear.

The air supply device according to the invention may advantageously be used in closed exhaust hoods.

I claim:

1. In an ejector air supply device for blowing ejector air into an exhaust hood;

said exhaust hood including an upper hood portion and a rear hood wall extending downwardly from said upper hood portion; an upper exhaust device being disposed in said upper hood portion for exhausting polluted air or other gases from the exhaust hood;

a casing located adjacent to said rear hood wall and provided with an elongated blow opening directed upwardly towards said upper exhaust device for entraining polluted air or other gases to be exhausted; the improvement wherein said casing is located at a position in front of and spaced from said rear hood wall and is in the form of an elongated substantially cylindrical body having an upper shield wall portion and an elongated blow opening between said wall shield portion and said rear hood wall;

the lower and rear substantially cylindrical surface of said casing being spaced from said rear hood wall and any supporting structure so as to enable polluted air or other gases to flow about the underside and around the rear of the casing and to be entrained by the ejector air flow created by said blow opening between said shield wall portion and said rear hood wall.

2. A device according to claim 1, wherein said shield wall portion is inclined towards said hood wall.

3. A device according to claim 1, wherein said casing is spaced from and above a table surface.

4. A device according to claim 1, wherein said casing has a rounded profile.

5. A device according to claim 1, wherein said casing and said shield wall is in one piece.

6. A device according to claim 5, wherein said casing and said shield wall are formed by a bent plate.

7. In a device according to claim 1, wherein said exhaust device comprises an elongated hood including said hood wall and adjoining side walls, the further improvement wherein said casing is divided into two casing portions which are connected with centrally located air feed means.

8. A device according to claim 7, wherein said air feed means comprises an air feed channel extending along said hood wall and connected to said two casing portions.

9. A device according to claim 8, wherein said air feed channel extends from an inlet opening in said hood and contains an air supply fan.

* * * * *